US005836656A

United States Patent [19]

Baggott

[11] Patent Number: 5,836,656

[45] Date of Patent: Nov. 17, 1998

[54] CHILD RESTRAINT

[76] Inventor: Ronald M. Baggott, 26771 Stafford, Mission Viejo, Calif. 92692

[21] Appl. No.: 869,726

[22] Filed: Jun. 5, 1997

[51] Int. Cl.[6] ..... A47C 31/00

[52] U.S. Cl. ..... 297/467; 297/468

[58] Field of Search ..... 297/467, 464, 297/468, 469, 483, 484, 485; 280/801.1

[56] References Cited

U.S. PATENT DOCUMENTS 5,118,163 6/1992 Brittian et al. .
5,143,420 9/1992 Switlik .
5,165,149 11/1992 Nihei .
5,248,187 9/1993 Harrison .

*Primary Examiner*—Milton Nelson, Jr.
*Attorney, Agent, or Firm*—Lyon & Lyon LLP

[57] ABSTRACT

A child restraint for use with a lap-type seat belt having a buckle assembly including a first belt section having a like buckle assembly adapted to couple with the buckle assembly of the seat belt. The restraint further includes a second belt section affixed to the first and forming a loop for encircling the torso of a child, and the second belt section also has a releasable belt buckle assembly at the ends thereof. A third belt section is secured to either or both of the first or second belt sections and extends from a front stomach area down under the crotch to the back of the child to be held in the second belt section, and the third belt section has a loop at the end thereof for encircling the second belt section at the front stomach area.

11 Claims, 2 Drawing Sheets

CHILD RESTRAINT

BACKGROUND OF THE INVENTION

With the advent of increased commercial air traffic, traveling by infants and small children is becoming more prevalent. It has been a practice of various airlines to allow infants and young children under the age of 2 years to travel on commercial airlines at no cost when the infant or child is held in a parent's or another adult's lap during flight and does not occupy a separate seat. Sometimes they have been allowed to fly free if a seat was available, but generally it is necessary to purchase a separate seat or ride in the adult's lap. Obviously, the purchase of a second seat is expensive and burdensome for most families. Having an unrestrained infant sit on an adult's lap is undesirable and increases the risk of death or injury should turbulence or an accident occur. The child held in the adult's lap is unrestrained and in the event of a crash, the child might be projected from the adult's lap and strike an object in the cabin. Further, if both the child and adult are in the same lap belt the weight of an adult, in the event of a crash or sudden stop, could crush the child.

Thus, there is a clear need for a practical child restraint for aircraft and similar travel. Several approaches have been proposed involving a child seat or other restraint, such as shown in U.S. Pat. No. 5,118,163 and U.S. Pat. No. 5,143,420. However, these devices are relatively complicated and cumbersome and further evidence the need for a simple and yet effective child restraint for these purposes.

SUMMARY OF THE INVENTION

The present invention provides a relatively simple form of child restraint and which couples directly to the buckle of a conventional lap-type seat belt. Conventional lap-seat belts used on airplanes and other vehicles have a buckle with a cooperating mating tongue which can be connected together and which are releasable to disconnect the seat belt. An exemplary embodiment of the present restraint includes a first short belt web or section having like buckle and tongue sections for mating with the tongue and buckle sections, respectively, of the lap-type seat belt. A second belt section or loop is secured to the web and terminates in its own releasable restraint buckle and tongue. A third loop is affixed to and extends from the web (in an area where the back of a child will be) and terminates in a loop (near the stomach of the child) through which the restraint buckle and tongue can extend and connect thereby providing support for the crotch of the infant or child and openings or areas through which the legs extend.

Accordingly, it is a principal object of the present invention to provide an improved child restraint.

A further object of the present invention is to provide a new and simple form of child restraint for use with conventional lap-type seat belts found in airplanes and other modes of transportation such as trains, buses, and the like.

Another object of the present invention is to provide a child restraint which buckles directly to the buckle of a conventional seat belt and which includes belt loops for encircling the torso and crotch of the child.

BRIEF DESCRIPTION OF THE DRAWINGS

These and other objects and features of the present invention will become better understood through a consideration of the following description, taken in connection with the drawings in which.

DETAILED DESCRIPTION

Figure 1:
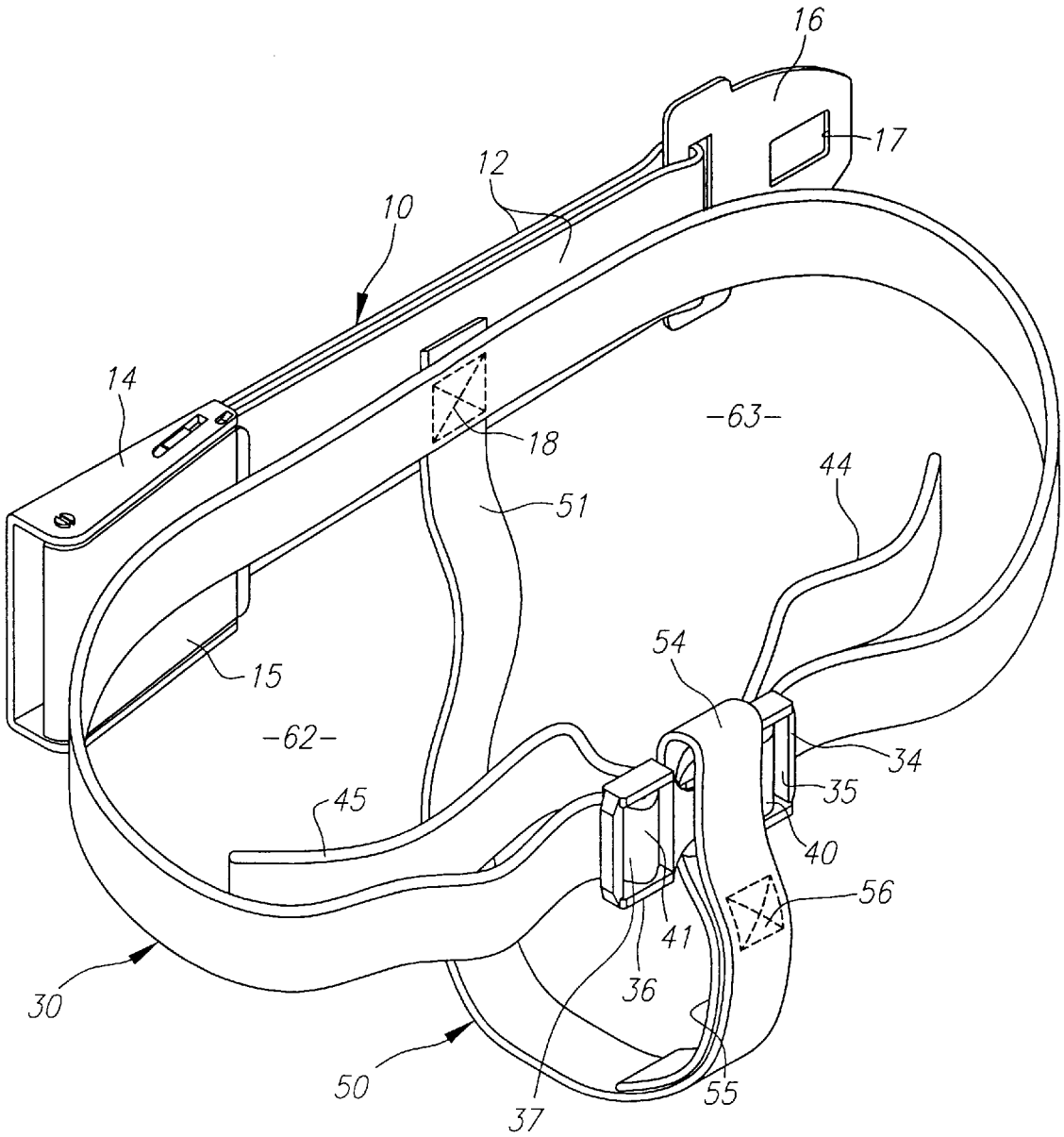
FIG. 1 is a perspective view of an exemplary infant or child restraint of the present invention.
Figure 2:
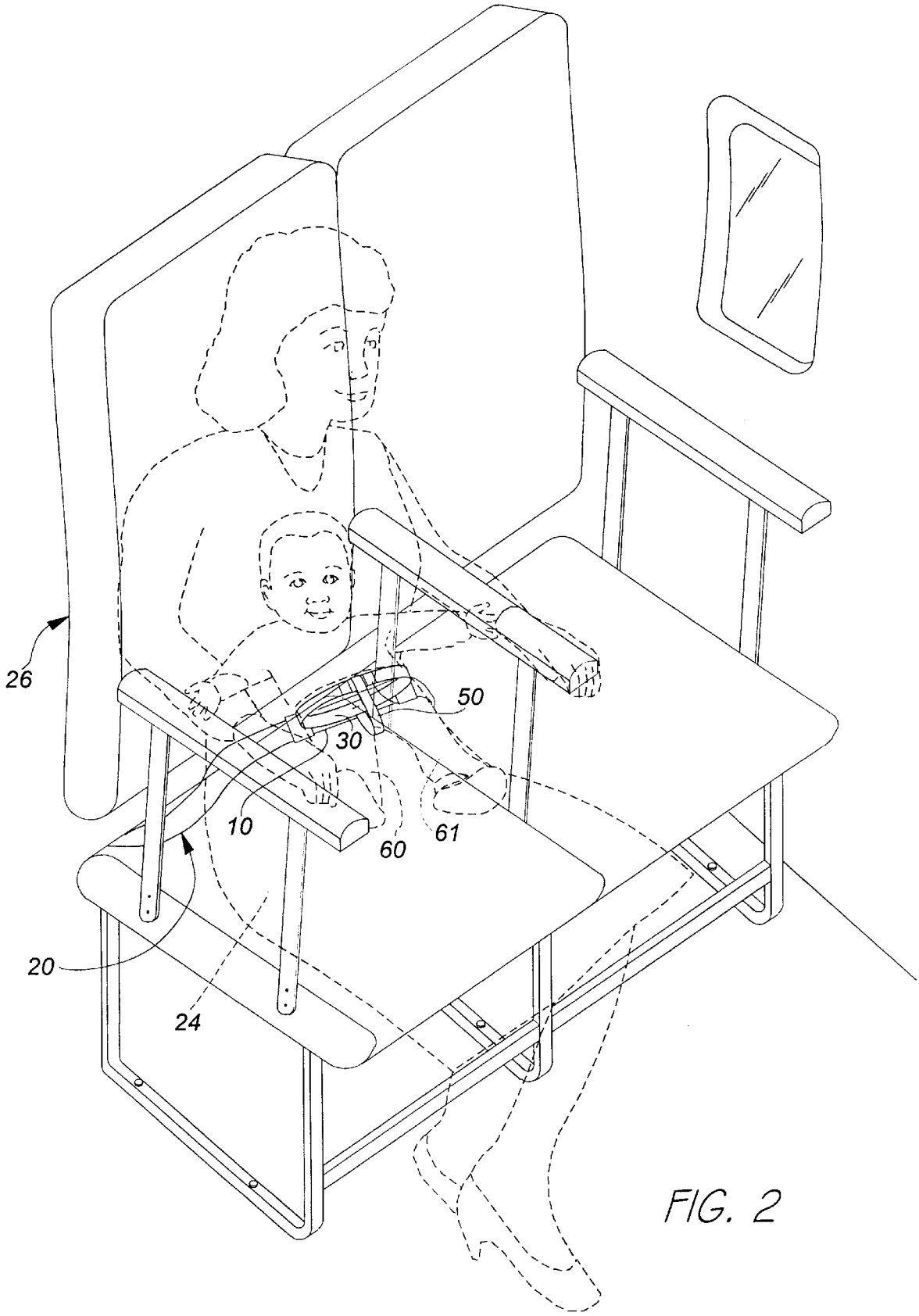
FIG. 2 is a perspective view showing the infant or child restraint as the same is used with an adult passenger seated in an airplane seat and infant or child.

Turning now to the drawings, FIG. 1 illustrates an exemplary embodiment of the child restraint (the term "child" is used to include infant or child) of the present invention and includes a short belt 10 comprising a short web of flexible belt material 12 attached to a buckle 14 and a tongue or latch plate 16 via a conventional loop or loops of the belt material 12 which is stitched together at any suitable location such as at stitching 18. The buckle 14 and tongue 16 are conventional buckle devices for mating with a like respective tongue and buckle of an aircraft seat belt 20 (note FIG. 2). Inasmuch as different aircraft have different forms of buckles and tongues, the buckle 14 and tongue 16 are selected to mate with the seat lap belt of the aircraft model and manufacturer for which the present child restraint is intended to be used.

The buckle 14 has the usual release lever 15 which has internal means for engaging (not shown) and locking with a slot 17 in the tongue 16 in a conventional manner. The user of the present child restraint buckles the buckle 14 to the tongue of the aircraft seat belt 20 and the tongue 16 to the buckle of the aircraft seat belt. Although this assembly 10 extends the length of the aircraft seat belt, the slack is easily taken up by tightening the belt at the buckle of the aircraft seat belt 20 in a conventional manner such that an adult passenger 24 (see FIG. 2) is suitably secured in an aircraft seat 26. The belt 12 can be adjustable at the buckle 14 if desired.

The present child restraint further includes a second flexible belt loop 30 designed of a length and size for encircling the torso of a child, and which terminates in a latch 34 and a latch plate 36. The latch 34 and plate 36 can be identical to the buckle 14 and tongue 16, but usually will comprise a smaller buckle assembly that will fit more comfortably adjacent the child. The latch 34 and plate 36 may include conventional respective openings 35 and 37 for receiving belt sections 40 and 41 therein for enabling the belt loop 30 to be suitably tightened around the torso of the child by pulling on the belt ends 44 and 45 in the usual manner to tighten (or loosen as the case may be) the belt 30 around the child. The belt 30 is suitably stitched at 18 to the flexible web 12 of the short belt 10.

In order to complete a seat harness-type device for holding the torso and hips of the child, a further third flexible belt section 50 is provided which extends from the back of the child, down under the crotch and up to the stomach. A first end 51 of the loop 50 is stitched at 18 to either or both of the belt 30 and the web 12. The second end has a loop 54 with an end 55 of the belt stitched together at 56, thus providing a secure loop 54. The size of the loop 54 is such that the latch 34 and latch plate 36 can be readily inserted therethrough so as to suitably support the child about the torso and under the crotch when the child's legs 60 and 61 (see FIG. 2) extend through leg openings 62 and 63 (FIG. 1) formed by the belt 30 and belt loop 50 as illustrated in FIG. 1. If desired, instead of the end 55 of the loop 50 being stitched at 56, a suitable belt adjuster (similar to the end 35 of the latch 34) can be provided so as to allow the loop 50 to be suitably adjusted about the crotch of the child.

It will be appreciated by those skilled in the art that the present child restraint is lightweight, easy to use, and easy to unbuckle in case of emergency. The restraint can be used in any seat on an airplane and in effect converts the seat to a child safety seat. The restraint is of simple design, is cost effective and the infant or child can be safely restrained while on the lap of an adult.

Different models of aircraft sometimes utilize different types or models of seat belt buckle assemblies. It will be appreciated that any of these can be accommodated by selecting the appropriate mating buckle 14 and tongue 16 assembly to fit that of the aircraft model involved. Furthermore, the child restraint of the present invention can be used for all other types of vehicles with conventional seat belts, including trains, buses, and the like.

While embodiments of the present invention have been shown and described, various modifications may be made without departing from the scope of the present invention, and all such modifications and equivalents are intended to be covered.

What is claimed is:

1. A child restraint for use with a lap-type seat belt having a buckle with cooperating mating male and female sections which are releasable to disconnect the buckle, and for use for a child having a torso, stomach, crotch and back, the child restraint comprising a first belt section affixed to male and female buckle sections which can mate and couple with the male and female buckle sections of a lap-type seat belt, a second belt section affixed to said first belt section and forming a loop for encircling the torso of a child, the second belt section having a releasable buckle assembly at ends thereof, and a third belt section secured to at least one of said first and second belt sections and for extending from a front stomach area down under the crotch to the back of a child to be disposed in the second belt section, the third belt section having a loop at an end thereof for encircling the second belt section.

2. A child restraint as in claim 1 wherein said third belt section is secured to said first belt section.

3. A child restraint as in claim 1 wherein said third belt section is secured to said second belt section.

4. A child restraint as in claim 1 wherein the buckle assembly of the second belt section includes openings for receiving ends of the second belt section in the form of loops for facilitating tightening and loosening of the second belt section about the torso of a child.

5. A child restraint as in claim 1 wherein the loop at the end of the third belt section is adjustable for enabling the same to be tightened or loosened to accommodate a different size child.

6. A child restraint for use with a lap-type seat belt having a first buckle assembly including a cooperating buckle and tongue which are releasable to disconnect the buckle, and for use for a child, having a torso, stomach, crotch and back, the child restraint comprising a first short belt section affixed to a second buckle assembly of a design like the first buckle assembly and comprising a buckle for mating with the tongue of the first buckle assembly and a tongue for mating with the buckle of the first buckle assembly, a second belt section forming a loop for encircling the torso of a child, the second belt section having a third buckle assembly at ends thereof, the third buckle assembly receiving at least a loop of the second belt section to allow the second belt section to be adjusted about the torso of a child, a third belt section having a first end for extending from the third buckle assembly adjacent the location of a stomach area of a child, down under a crotch and back to a second end near the back of a child to be held in the second belt section, the second end of the third belt section and a central portion of the second belt section being securely fastened to the central section of the first belt section, and the first end of the third belt section being formed into a loop for encircling a portion of the second belt section.

7. A child restraint for use with a lap-type seat belt having a first buckle assembly including a cooperating buckle and tongue which are releasable to disconnect the buckle, and for use for a child having a torso, stomach, crotch and back, the child restraint comprising a first short belt section affixed to a second buckle assembly of a design like the first buckle assembly and comprising a buckle for mating with the tongue of the first buckle assembly and a tongue for mating with the buckle of the first buckle assembly, a second belt section forming a loop for encircling the torso of a child, the second belt section having a third buckle assembly, the third buckle assembly coupled to at least a portion of the second belt section to allow the second belt section to be adjusted about the torso of a child, and a third belt section having a first end for extending from the third buckle assembly adjacent the location of a stomach area of a child, down under a crotch and back to a second end near the back of a child to be held in the second belt section, the second end of the third belt section and a portion of the second belt section being fastened to the first belt section.

8. A child restraint as in claim 7 wherein the lap-type seat belt is an aircraft seat belt.

9. A child restraint as in claim 7 where said third belt section is secured to a central portion of said first belt section, and said first end of the third belt section is secured to said second belt section.

10. A child restraint as in claim 7 wherein the buckle assembly of the second belt section includes an opening for receiving an end of the second belt section for facilitating tightening and loosening of the second belt section about the torso of a child.

11. A child restraint as in claim 7 wherein the third belt section has a loop at the first end of the third belt section which is adjustable for enabling the same to be tightened or loosened to accommodate a different size child.

* * * * *